US006485268B1

(12) United States Patent
Hugenroth et al.

(10) Patent No.: US 6,485,268 B1
(45) Date of Patent: Nov. 26, 2002

(54) OIL UTILIZED AS MOTOR PROTECTOR TRIP FOR SCROLL COMPRESSOR

(75) Inventors: Jason Hugenroth, Hope, AR (US); Thomas Barito, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 19 days.

(21) Appl. No.: 09/690,275

(22) Filed: Oct. 17, 2000

(51) Int. Cl.[7] ..... F04B 39/04; F04B 39/06
(52) U.S. Cl. ..... 417/228
(58) Field of Search ..... 417/228, 13; 184/6.1, 184/6.4

(56) References Cited

U.S. PATENT DOCUMENTS 4,349,149 A * 9/1982 Humpert ..... 137/100
4,823,593 A * 4/1989 Furlong et al. ..... 128/204.24
5,651,342 A * 7/1997 Hara ..... 123/339.1
6,059,540 A * 5/2000 Ni ..... 417/228
6,125,642 A * 10/2000 Seener et al. ..... 184/103.1
6,161,563 A * 12/2000 Mankins ..... 137/15.07
6,212,699 B1 * 4/2001 Tremblay ..... 4/363
6,280,146 B1 * 8/2001 Bush et al. ..... 417/13
6,302,654 B1 * 10/2001 Millet et al. ..... 417/228
6,318,638 B1 * 11/2001 Banno et al. ..... 236/12.2

* cited by examiner

*Primary Examiner*—Teresa Walberg
*Assistant Examiner*—Daniel Robinson
(74) *Attorney, Agent, or Firm*—Carlson, Gaskey & Olds

(57) ABSTRACT

A scroll compressor has lubricant flow which passes lubricant over a portion of a compressor pump set which will be at an elevated temperature under certain adverse conditions. If the adverse conditions are occurring, then this lubricant will reach an elevated temperature. This lubricant is returned over a motor protector such that it can cause the motor protector to trip and stop further operation of the scroll compressor. The flow of lubricant can be selective, and only occur when a predetermined temperature is reached by a sensing unit, or can be ongoing.

17 Claims, 3 Drawing Sheets

OIL UTILIZED AS MOTOR PROTECTOR TRIP FOR SCROLL COMPRESSOR

BACKGROUND OF THE INVENTION

This invention relates to a system which optimizes the flow of a lubricant over portions of a scroll compressor which become hot during reverse rotation or loss of charge, and then passing the heated lubricant onto a motor protector.

Scroll compressors are becoming widely utilized in refrigerant compression applications. In a scroll compressor a first scroll member has a base and a generally spiral wrap extending from the base. The wrap of the first scroll member interfits with the wrap from a second scroll member. The second scroll member is caused to orbit relative to the first, and refrigerant is entrapped between the scroll wraps. As the second scroll member orbits the size of the compression chambers which entrap the refrigerant are reduced, and the refrigerant is compressed.

There are certain design challenges with a scroll compressor. As an example, while the scroll compressor efficiently compresses refrigerant when rotated in a proper forward direction, there are undesirable side effects if the scroll compressor is driven to rotate in a reverse direction. Moreover, if the level of refrigerant or charge level, being passed through the compressor is lower than expected, there may also be undesirable side effects. Among the many undesirable side effects is an increased heat level at the scroll compressor members.

One safety feature incorporated into most sealed compressors is the use of a motor protector associated with the electric motor for driving the compressor. The same is true in a scroll compressor, wherein a motor protector is typically associated with the stator for the electric motor. The motor protector operates to stop rotation of the motor in the event there is an electrical anomaly, or if the motor protector senses an unusually high temperature. However, the problems mentioned above with regard to reverse rotation and loss of charge typically cause heat to increase at the compressor pump set, or the scrolls, which is relatively far from the motor. Thus, it may take an undue length of time for the additional heat being generated in the compressor pump set to pass to the motor protector.

SUMMARY OF THE INVENTION

In the disclosed embodiment of this invention, lubricant is caused to flow over a portion of the compressor pump set and be heated, at least when there are adverse conditions in the compressor pump set. This heated lubricant is then passed to a motor protector. This will cause the motor protector to trip the motor and stop further rotation.

In preferred embodiments, the heated portion of the compressor over which the lubricant is passed is the non-orbiting scroll. Alternatively, in some embodiments the heated lubricant can pass over the orbiting scroll.

In one general type of disclosed embodiment, the flow of lubricant back to the motor protector is selective, and will only occur if a particularly high temperature is reached. At other times, the lubricant is directed to a normal return path.

These and other features of the present invention can be best understood from the following specification and drawings, the following which is a brief description.

DETAILED DESCRIPTION OF PREFERRED EMBODIMENTS

Figure 1:
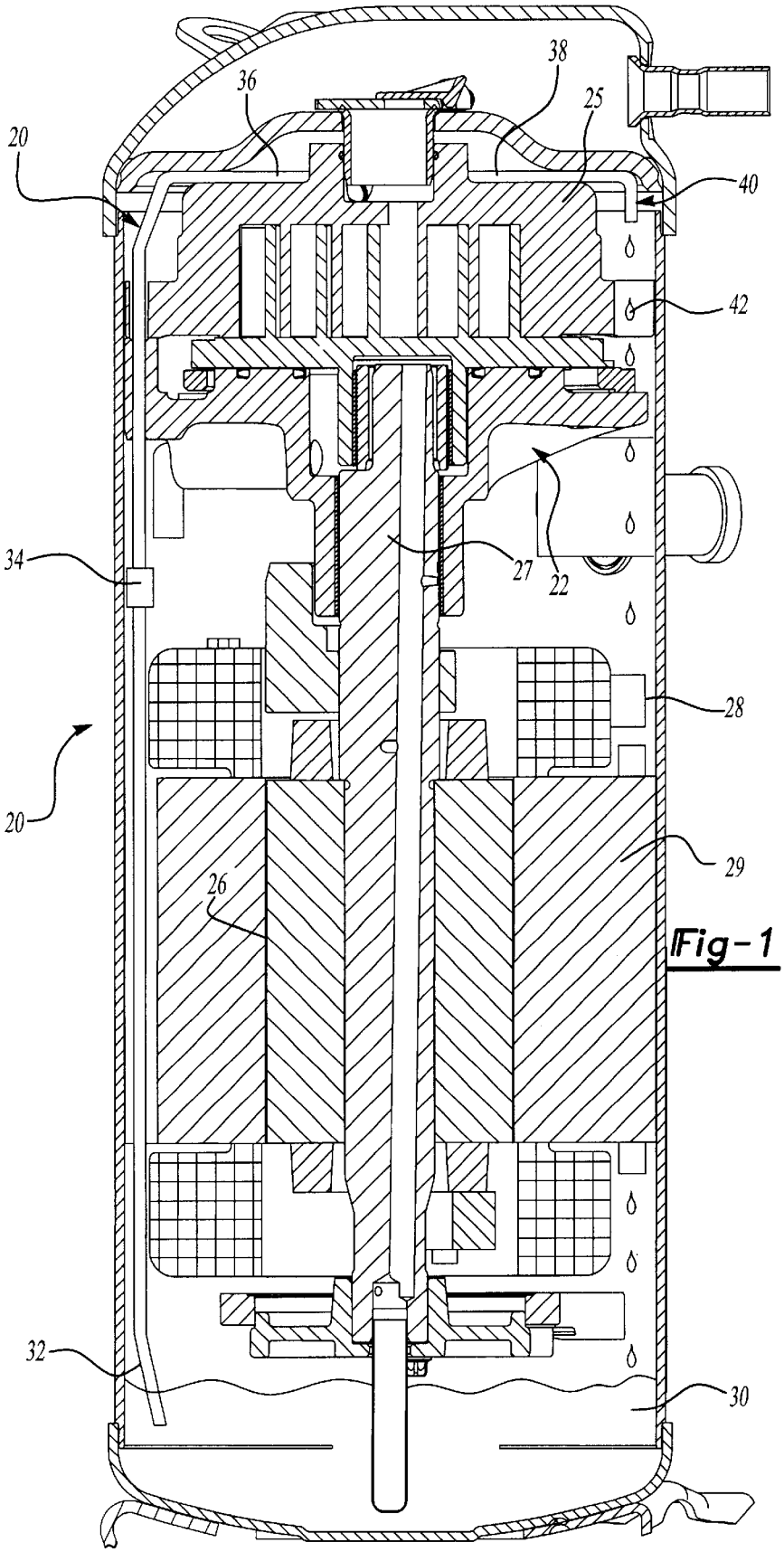
FIG. 1 is a cross-sectional view through a first embodiment compressor.

FIG. 1 shows a scroll compressor 20 having a compressor pump set 22 which incorporates an orbiting scroll and a non-orbiting scroll 25, as known. A compressor rotor 26 drives a shaft 27 to drive the orbiting scroll, as known. A motor protector 28 is associated with the motor stator 29. A lubricant level 30 is positioned beneath the motor. An oil feed tube 32 extends upwardly from the lubricant sump 30 and a lubricant is driven through a pump 34 on the feed tube 32. The pump 34 may be driven by any known means. As an example, a separate motor may be provided, or the motor could be driven by a power takeoff from the shaft 27. This figure shows the pump 34 schematically, and a worker in this art would recognize how to drive the motor 34. The tube 32 has downstream portions 36 and 38 downstream from the pump 34. These portions pass over the non-orbiting scroll 25. An outlet 40 is positioned above the motor protector 28, such that heated lubricant 42 is returned onto the motor protector 28.

In operation, should conditions within the compressor pump set 22 be as expected, the lubricant 42 will not be at a predetermined high temperature. That is, while the lubricant 42 may be heated, it will not be heated to a sufficient amount that it will trip the motor protector 28. However, should there be an adverse condition in the compressor pump unit 22, such as reverse rotation or a loss of charge situation, then the temperature of the lubricant 42 will be elevated. Once the temperature reaches a predetermined amount it will trip the motor protector 28 and cause the motor protector 28 to stop further rotation of the motor.

Figure 2:
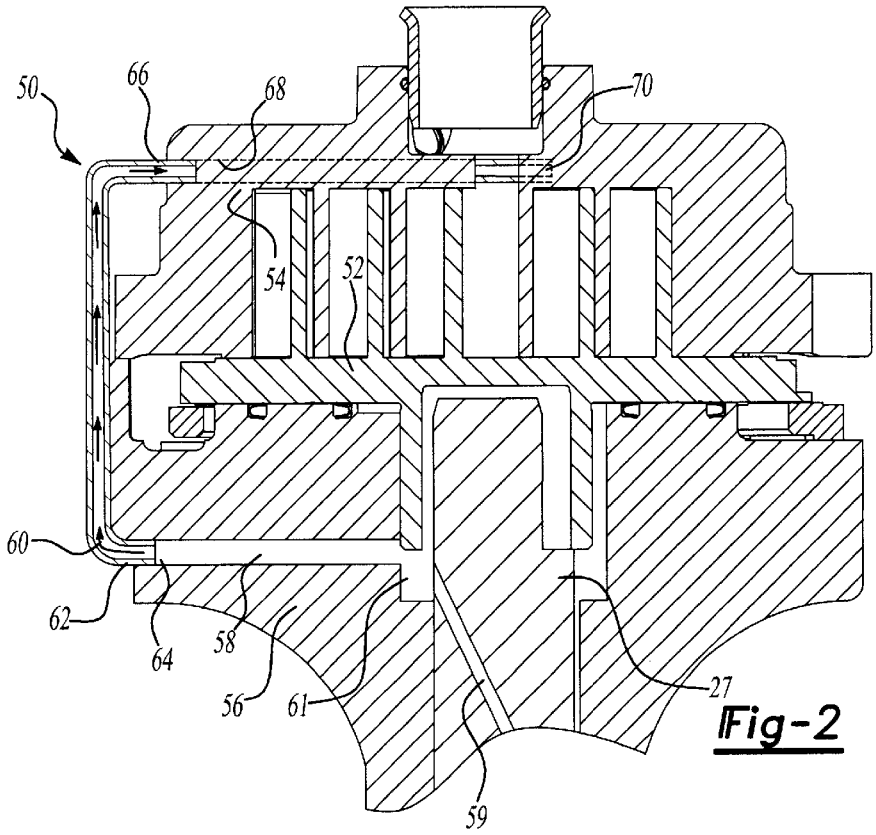
FIG. 2 is a cross-sectional view through a second embodiment scroll compressor.

FIG. 2 shows another embodiment 50. In embodiment 50, the orbiting scroll 52 is associated with the non-orbiting scroll 54. A crankcase 56 supports the orbiting scroll 52 and has a lubricant passage 58 communicating with a shaft 27. The shaft 27, shown schematically here, is configured to have a lubricant feed tube 59 supplying lubricant to the chamber 61. This portion of the invention is as known in the scroll compressor art. The passage 58 communicates with a tube 60 having a tube end 62 received in an opening 64 which communicates with the passage 58. The tube 60 further has a second end 66 inserted into a bore 68 in the non-orbiting scroll 54. This passage 68 communicates with a further passage 70 which wraps around the body of the non-orbiting scroll 54, and then communicates with an outlet 40 much like the outlet shown in FIG. 1. This embodiment differs from the FIG. 1 embodiment largely in the fact the oil feed is obtained from the passage 58, rather than directly from the sump. The pumping action of the passage 59 will drive the lubricant through its path in this embodiment.

Figure 3:
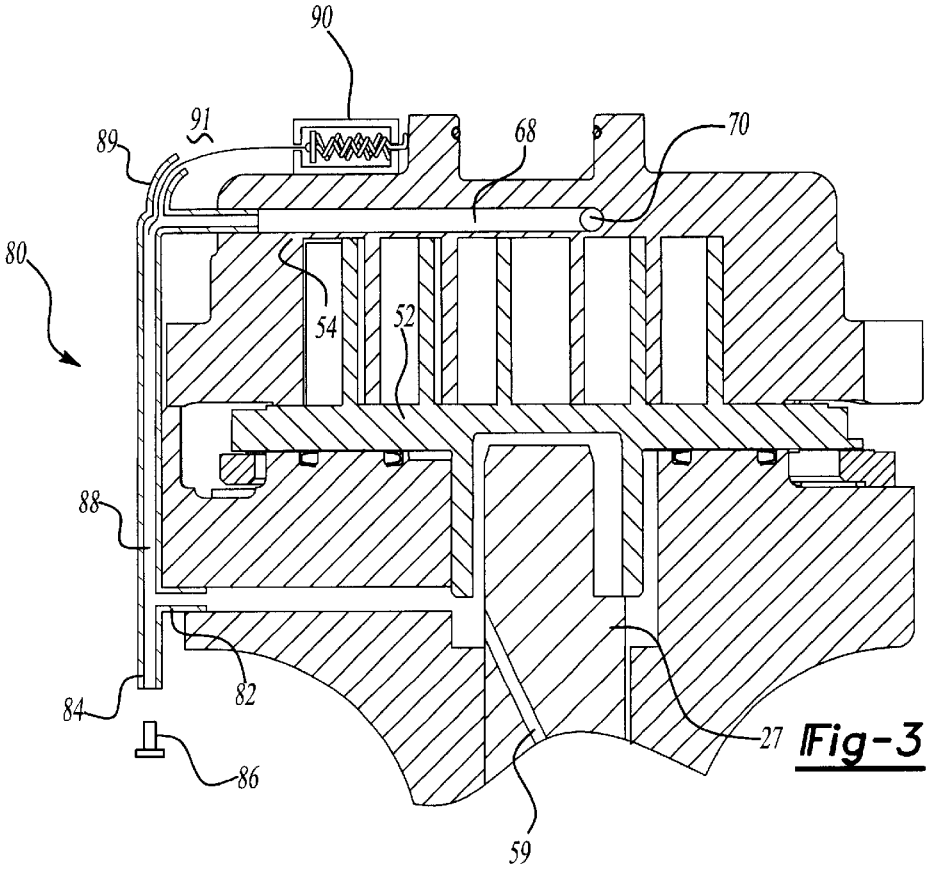
FIG. 3 shows a modification to the FIG. 2 embodiment.
Figure 4:
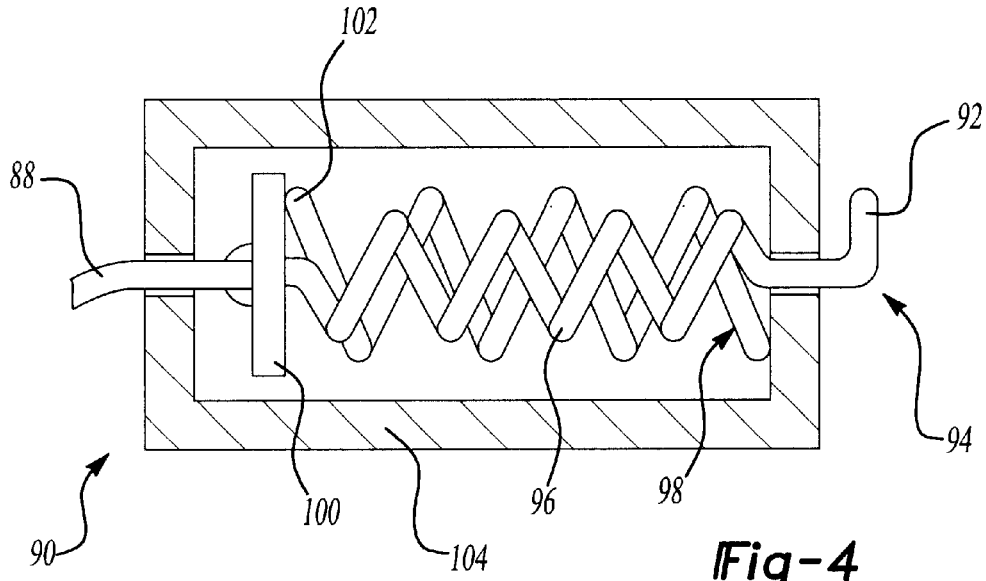
FIG. 4 is an enlarged view of a portion of the FIG. 3 embodiment.

FIGS. 3 and 4 shows a further embodiment 80 which is slightly modified from the FIG. 2 embodiment. In this embodiment the oil tube 82 includes a downwardly extending return opening 84 selectively closed by a plug 86. The plug 86 is connected to a cord 88 which extends through a small passage 89 to an actuator mechanism 90.

As shown in FIG. 4, the mechanism 90 incorporates a clip spring 92 having a clip end 94 positioned outwardly of a housing 104. This holds a spring member 96 at a predetermined position. The member 92 is formed of a shape memory alloy tension spring. As this member increases in temperature, it will contract in length or size. A second spring 98 is applying a bias force through a spring end 102 sitting against a flange 100 which is part of the spring 92.

During normal operation, the spring 98 holds the spring 92 and cord 88 in the position illustrated in FIGS. 3 and 4. The plug 86 is allowed to move downwardly to the position such as shown in FIG. 3. However, should the temperature on the spring 92 increase beyond a predetermine level, it will begin to contract in size. As it contracts in size it overcomes the force from spring 98 and the cord 88 is pulled to the right in FIG. 4. This pulls the plug 86 upwardly such that it will close the opening 84. At that time, lubricant will flow upwardly and into the passage 68–70, such as explained with reference to FIG. 2. From the passage 70 the lubricant is returned such as through an outlet 40 directed above a motor protector 28. This embodiment provides a system wherein the lubricant is only passed over the non-orbiting scroll in the event that a predetermined condition is likely to exist. The lubricant will thus be heated such that it will trigger the motor protector, and stop operation under adverse conditions.

Figure 5:
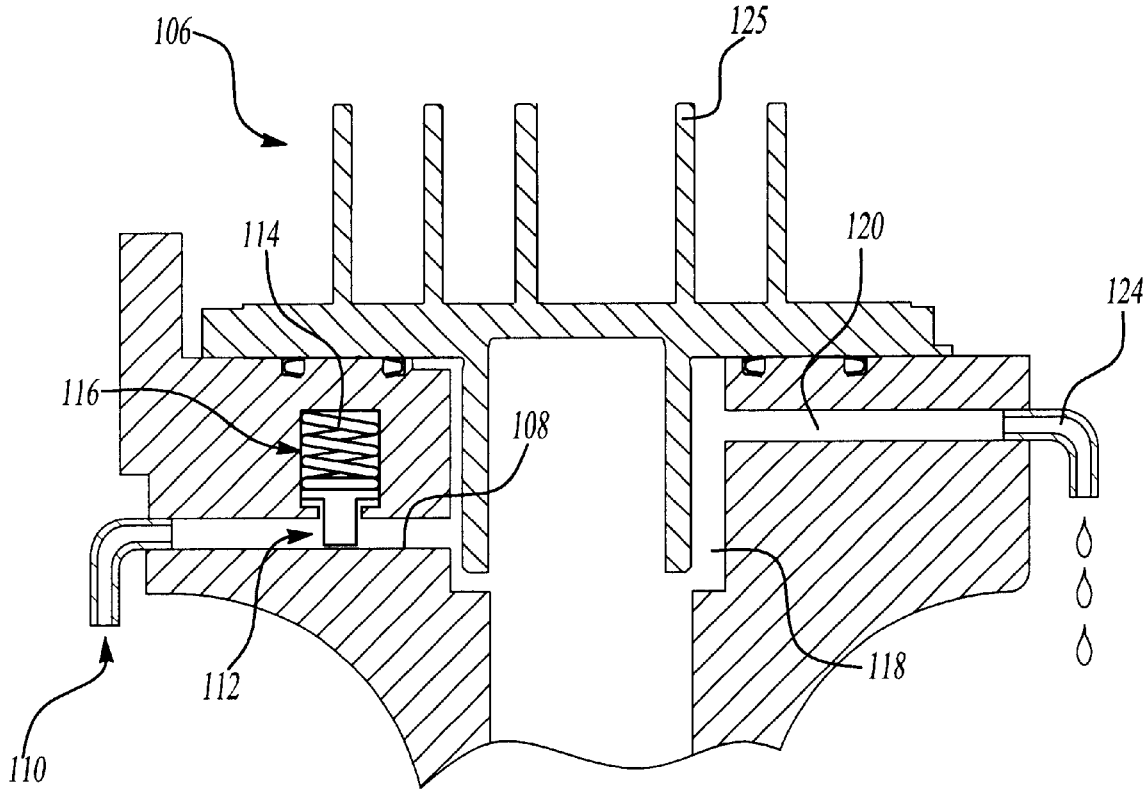
FIG. 5 shows yet another embodiment.

FIG. 5 shows another embodiment 106, wherein a passage 108 communicates with a normal oil return path tube 110. Oil will return from passage 108 back downwardly through the tube 110. A valve 112 selectively closes this path when a spring 114 force is overcome by a spring 116. The spring 114 pulls the valve 112 upwardly. The spring 116 is a temperature sensitive spring and will increase in the length as its temperature increases. As the temperature surrounding the valve 112 increases, the spring 116 will force the valve 112 downwardly to close communication between passages 108 and 110. At that time, lubricant within a chamber 118 will no longer move into the passage 108. Instead, the lubricant will be forced upwardly into a passage 120, and from passage 120 it will communicate with an alternative oil path 124 which is positioned above the motor protector 28. The positioning of the passage 120 closer to the orbiting scroll 125 ensures that better heat transfer is achieved. That is, the passage 120 is closer to the orbiting scroll 125 than is passage 108.

While the invention has been disclosed for reacting to a predetermined high temperature, it should be understood that other conditions could cause the actuation. As an example, high pressure ratios or low suction pressure.

Although preferred embodiments of this invention have been disclosed, a worker in this art would recognize that certain modifications would come within the scope of this invention. For that reason, the following claims should be studied to determine the true scope and content of this invention.

What is claimed is:

1. A scroll compressor comprising:

a compressor pump unit having a first scroll member having a base and generally spiral wrap extending from said base, a second scroll member having a base and a generally spiral wrap extending from said base, said spiral wraps of said first and second scroll members interfitting to define compression chambers, and a crankcase for supporting said second scroll member;

a shaft for driving said second scroll member to orbit relative to said first scroll member, and compression chambers between said wraps of said first and second scroll member decreasing in size as said second scroll member orbits to compress an entrapped refrigerant;

a motor for driving a shaft to cause said second scroll member to orbit, said motor having a rotor and a stator, and a motor protector associated with said motor stator, said motor protector being operable to stop further operation of said motor in the event it senses an undesired condition; and an oil return passage for passing lubricant over a heating portion of said compressor pump unit, said oil return passage being positioned to return oil from said heating portion of said compressor pump unit onto said motor protector, said passage including a portion in said first scroll member base.

2. A scroll compressor as recited in claim 1, wherein said portion of said compressor pump unit is said first scroll member.

3. A scroll compressor comprising:

a compressor pump unit having a first scroll member having a base and generally spiral wrap extending from said base, a second scroll member having a base and a generally spiral wrap extending from said base, said spiral wraps of said first and second scroll members interfitting to define compression chambers, and a crankcase for supporting said second scroll member;

a shaft for driving said second scroll member to orbit relative to said first scroll member, and compression chambers between said wraps of said first and second scroll member decreasing in size as said second scroll member orbits to compress an entrapped refrigerant;

a motor for driving a shaft to cause said second scroll member to orbit, said motor having a rotor and a stator, and a motor protector associated with said motor stator, said motor protector being operable to stop further operation of said motor in the event it senses an undesired condition;

an oil return passage for passing lubricant over a heating portion of said compressor pump unit, said oil return passage being positioned to return oil from said portion of said compressor pump unit onto said motor protector; and an oil tube communicates downwardly into a oil sump at an end of said compressor remote from said compressor pump unit, and a pump on said oil tube drives lubricant from said oil sump upwardly onto said heating portion of said compressor pump unit.

4. A scroll compressor as recited in claim 3, wherein said tube passes round a central axis of said portion of said compressor pump unit such that lubricant within said tube is exposed to said portion of said compressor pump unit for a relatively long period of time.

5. A scroll compressor as recited in claim 1, wherein said tube has a downwardly extending outlet portion downstream of a portion which contacts said heating portion of said compressor pump unit, said downwardly extending portion being positioned above said motor protector.

6. A scroll compressor as recited in claim 1, wherein the communication of lubricant to said heating portion of said compressor pump unit is selective and occurs once a predetermined temperature is sensed by a sensor associated with said compressor pump unit.

7. A scroll compressor as recited in claim 6, wherein a valve is moved by a temperature sensitive member to allow flow of lubricant over said heating portion of said compressor pump unit, or prevent flow of lubricant over said compressor pump unit based upon a sensed temperature.

8. A scroll compressor as recited in claim 7, wherein said valve includes a valve member movable to block communication between two flow passages in the event said predetermined temperature is reached.

9. A scroll compressor comprising:

a compressor pump unit having a first scroll member having a base and generally spiral wrap extending from said base, a second scroll member having a base and a generally spiral wrap extending from said base, said spiral wraps of said first and second scroll members interfitting to define compression chambers, and a crankcase for supporting said second scroll member;

a shaft for driving said second scroll member to orbit relative to said first scroll member, and compression chambers between said wraps of said first and second scroll member decreasing in size as said second scroll member orbits to compress an entrapped refrigerant;

a motor for driving a shaft to cause said second scroll member to orbit, said motor having a rotor and a stator, and a motor protector associated with said motor stator, said motor protector being operable to stop further operation of said motor in the event it senses an undesired condition;

an oil return passage for passing lubricant over a portion of said compressor pump unit, said oil return passage being positioned to return oil from said portion of said compressor pump unit onto said motor protector;

the communication of lubricant to said portion of said compressor pump unit is selective and occurs once a predetermined temperature is sensed by a sensor associated with said compressor pump unit;

a valve is moved by a temperature sensitive member to allow flow of lubricant over said portion of said compressor pump unit, or prevent flow of lubricant over said compressor pump unit based upon a sensed temperature;

said valve includes a valve member movable to block communication between two flow passages in the event said predetermined temperature is reached; and said valve is biased outwardly by a temperature sensitive spring to be at said blocking position, and a second motor protector oil return passage then communicates with oil being returned when said valve is moved to said blocking position.

10. A scroll compressor as recited in claim 9, wherein said temperature sensitive spring includes a pair of springs with at least one of said springs being temperature sensitive, and a cord connected to a blocking plug, said cord being movable based upon movement of said temperature sensitive spring, said cord selectively pulling said plug for blocking a return passage for returning a lubricant to a sump, and said lubricant being moved over said portion of said compressor pump unit when said plug blocks said return passage.

11. A scroll compressor as recited in claim 9, wherein there is a first return passage extending in one radial direction within some crankcase and a second return passage extending in a second radial direction, said valve being received within said first passage, and when said valve closes at first passage, lubricant flowing into said second passage and on to said motor protector.

12. A scroll compressor as recited in claim 11, wherein said second passage is positioned at a vertically higher location than said first passage such that said second passage is closer to said second scroll, and further presents more resistance to flow of lubricant than said first passage.

13. A scroll compressor as recited in claim 1, wherein an oil tube communicates a portion of said crankcase to said first scroll member, said tube communicating lubricant onto said first scroll member, and said first scroll member being said portion of said compressor pump unit, and said oil tube including a downwardly extending motor protector portion for directing oil from said tube onto said motor protector.

14. A scroll compressor as recited in claim 13, wherein the flow of lubricant through said passage is selectively allowed only when a predetermined condition is sensed by a sensing unit.

15. A scroll compressor as recited in claim 1, wherein said undesired condition is a predetermined high temperature.

16. A scroll compressor comprising:

a compressor pump unit having a first scroll member having a base and generally spiral wrap extending from said base, a second scroll member having a base and a generally spiral wrap extending from said base, said spiral wraps of said first and second scroll members interfitting to define compression chambers, and a crankcase for supporting said second scroll member;

a shaft for driving said second scroll member to orbit relative to said first scroll member, and compression chambers between said wraps of said first and second scroll member decreasing in size as said second scroll member orbits to compress an entrapped refrigerant;

a motor for driving a shaft to cause said second scroll member to orbit, said motor having a rotor and a stator, and a motor protector associated with said motor stator, said motor protector being operable to stop further operation of said motor in the event it senses a predetermined high temperature; and an oil return passage for passing lubricant over said first scroll member and then returning oil from said first scroll member onto said motor protector, said oil passage being selectively opened by a movable valve, when a predetermined temperature is reached in said compressor pump unit.

17. A scroll compressor as recited in claim 16, wherein said valve is biased outwardly to a closed position by a temperature sensitive spring, and said temperature sensing spring being resisted by a second spring tending to move said valve to an open position.

* * * * *

UNITED STATES PATENT AND TRADEMARK OFFICE

CERTIFICATE OF CORRECTION

PATENT NO. : 6,485,268 B1
DATED : November 26, 2002
INVENTOR(S) : Hugenroth et al.

It is certified that error appears in the above-identified patent and that said Letters Patent is hereby corrected as shown below:

Column 4,
Line 46, “round” should be -- around --.

Signed and Sealed this

Thirteenth Day of May, 2003

JAMES E. ROGAN
*Director of the United States Patent and Trademark Office*